US006702572B2

(12) United States Patent
Hong et al.

(10) Patent No.: US 6,702,572 B2
(45) Date of Patent: Mar. 9, 2004

(54) ULTRA-STABLE FLARE PILOT AND METHODS

(75) Inventors: Jianhui Hong, Tulsa, OK (US); Joseph D. Smith, Owasso, OK (US); Roger Poe, Beggs, OK (US); Robert E. Schwartz, Tulsa, OK (US)

(73) Assignee: John Zink Company, LLC, Tulsa, OK (US)

( * ) Notice: Subject to any disclaimer, the term of this patent is extended or adjusted under 35 U.S.C. 154(b) by 59 days.

(21) Appl. No.: 09/933,422

(22) Filed: Aug. 20, 2001

(65) Prior Publication Data

US 2003/0036029 A1 Feb. 20, 2003

(51) Int. Cl.[7] ..... F23D 14/70; F23G 7/08

(52) U.S. Cl. ..... 431/202; 431/5; 431/352; 431/285; 431/75

(58) Field of Search ..... 431/202, 5, 114, 431/350, 351, 352, 285, 278, 74, 75, 353

(56) References Cited

U.S. PATENT DOCUMENTS

| | | | | | |
|---|---|---|---|---|---|
| 2,779,399 | A | | 1/1957 | Zink et al. | 158/115 |
| 2,869,631 | A | | 1/1959 | Zink | 158/115 |
| 3,002,553 | A | | 10/1961 | Reed | 158/116 |
| 3,247,885 | A | | 4/1966 | Reed | 158/99 |
| 3,431,057 | A | | 3/1969 | Reed | 431/263 |
| 3,729,287 | A | | 4/1973 | Strashok | 431/202 |
| 3,932,111 | A | * | 1/1976 | Liknes et al. | 431/202 |
| 4,025,281 | A | * | 5/1977 | Lapp | 431/5 |
| 4,128,393 | A | * | 12/1978 | Sneed | 431/351 |
| 4,269,583 | A | | 5/1981 | Straitz, III | 431/202 |
| 4,419,071 | A | * | 12/1983 | Schwartz | 431/202 |
| 4,826,427 | A | | 5/1989 | Hyde | 431/202 |
| 4,906,175 | A | * | 3/1990 | Guerra | 431/5 |
| 4,976,608 | A | * | 12/1990 | Hyde | 431/202 |
| 5,055,032 | A | * | 10/1991 | Altemark et al. | 431/352 |
| 5,429,496 | A | * | 7/1995 | Stephens et al. | 431/202 |
| 5,813,849 | A | | 9/1998 | Schwartz et al. | 431/202 |

FOREIGN PATENT DOCUMENTS

| | | | |
|---|---|---|---|
| EP | 0 476 548 A | * | 3/1992 |
| EP | 0 935 098 A1 | | 8/1999 |
| GB | 1058410 | | 2/1967 |
| JP | 53-98530 A | * | 8/1978 |

* cited by examiner

*Primary Examiner*—Josiah Cocks
(74) *Attorney, Agent, or Firm*—McAfee & Taft

(57) ABSTRACT

A continuously operating ultra-stable flare pilot for igniting a flammable fluid discharged from the open end of a flare stack and methods are provided. The flare pilot basically comprises a fuel-air mixture inlet conduit, a fuel-air mixture discharge nozzle attached to the fuel-air mixture inlet conduit and a wind shield having a lower end attached to the fuel-air mixture discharge nozzle or the fuel-air mixture inlet conduit. The wind shield has an open upper end which includes an upstanding wall portion facing the open end of the flare stack and the wind shield includes an outwardly extending wind capturing baffle attached to each of the opposite sides of the wind shield positioned substantially around openings in the wind shield through which captured wind can flow into the interior of the wind shield.

44 Claims, 3 Drawing Sheets

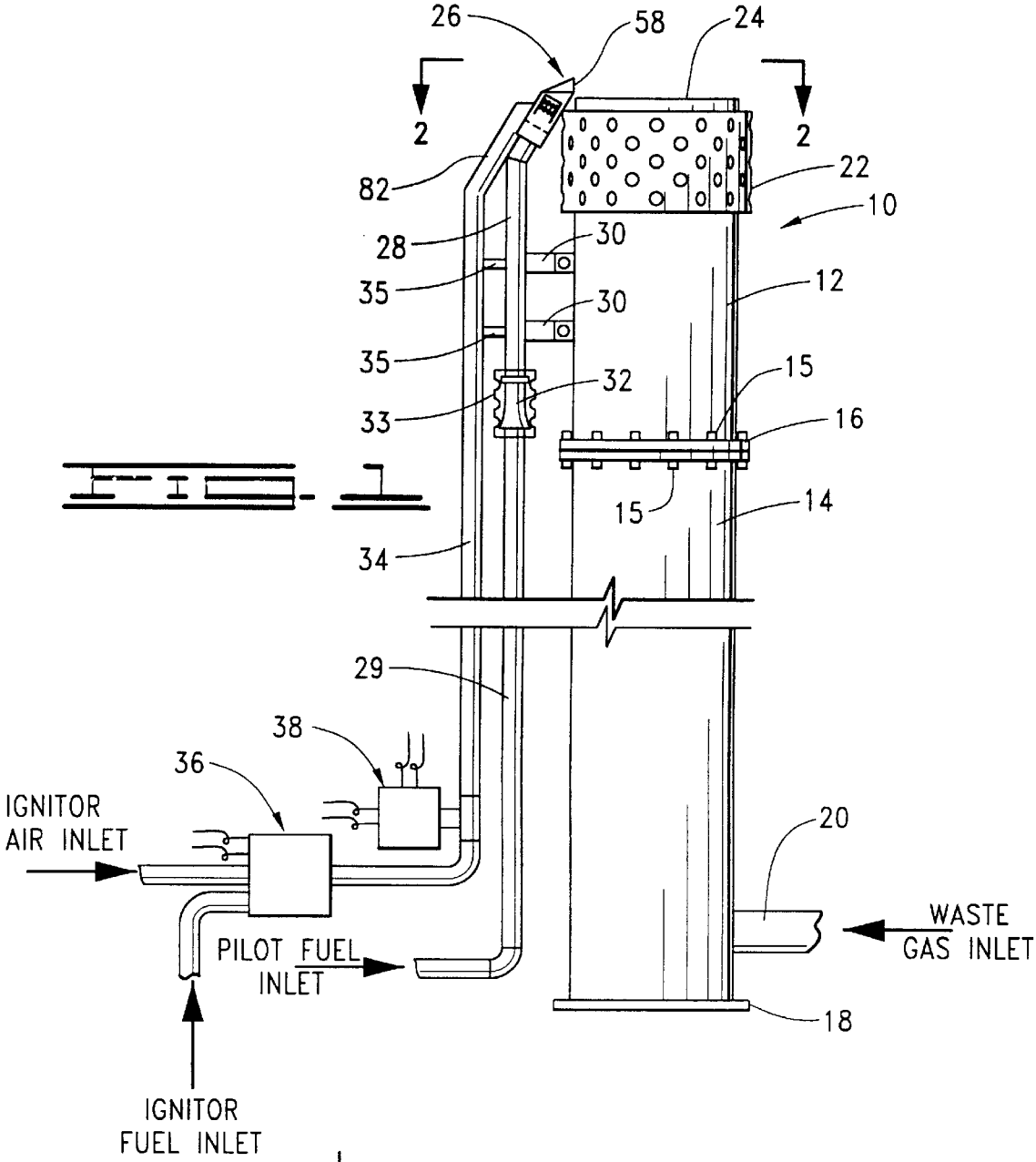
26
58
24
2
2
82
22
10
28
30
35
30
12
35
15
32
33
16
15
14
34
29
38
36
IGNITOR
AIR INLET
20
WASTE
GAS INLET
PILOT FUEL
INLET
18
IGNITOR
FUEL INLET
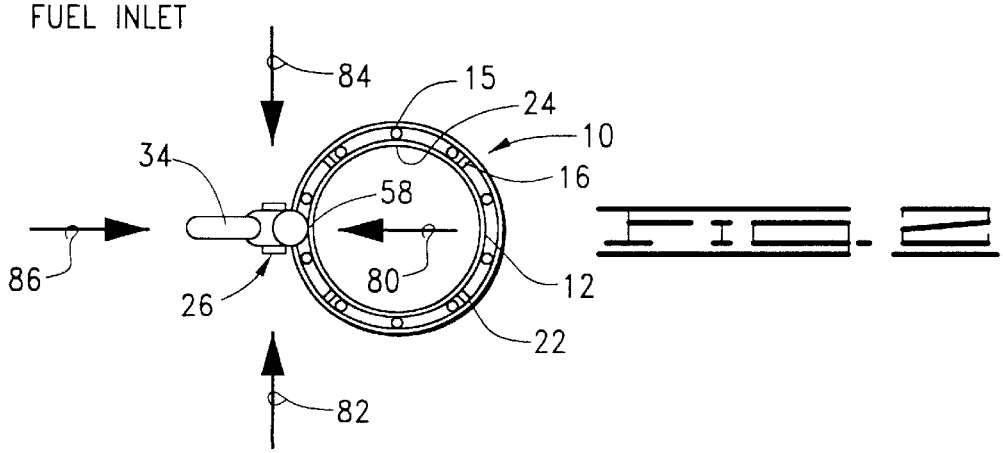
84
15
24
10
34
16
58
86
80
12
26
22
82

ULTRA-STABLE FLARE PILOT AND METHODS

BACKGROUND OF THE INVENTION

1. Field of the Invention

The present invention relates to an improved flare pilot which is stable in high winds and other severe weather conditions.

2. Description of the Prior Art

A variety of apparatus for flaring combustible waste fluid streams have been developed and used heretofore. Such apparatus are often referred to as flare stacks. Flare stacks are commonly located at production, refining and other processing plants for disposing of combustible wastes or other combustible streams which are diverted during venting, shut-downs, upsets and/or emergencies. Flare stacks generally include continuously operating pilots (often referred to as pilot lights) and flame detection apparatus which are often located at the elevated open discharge end of the flare stacks.

While the flare pilots utilized heretofore have operated successfully during normal weather conditions, at the time of high winds and other severe weather conditions both the burning waste or other fluid being flared and the pilot flame have been extinguished which allows the waste or other fluid to be discharged directly into the atmosphere without being burned. The unburned waste or other fluid pollutes the atmosphere which can be harmful to plant, animal and human life.

In order for a continuously operating flare pilot to remain lit and continue to ignite the combustible fluid discharged from a flare stack during severe weather conditions such as those which exist in hurricanes, typhoons and other similar weather conditions, the flare pilot must remain lit at wind speeds up to 125 mph or more when combined with two inches or more of rainfall per hour. In addition, gases which are often used as fuel for flare pilots are typically made up of natural gas or propane or a mixture of hydrocarbon gases that may contain hydrogen. A flare pilot utilizing gases as fuel which contain hydrogen must be capable of burning the gases without flashback due to the presence of the hydrogen.

Thus, there are needs for improved ultra-stable flare pilots which remain lit in high winds and other severe weather conditions.

SUMMARY OF THE INVENTION

The present invention provides improved continuously operating flare pilots which meet the needs described above and overcome the deficiencies of the prior art. The continuously operating flare pilot of this invention is stable in high winds and other severe weather conditions including wind speeds up to 160 mph or more and rainfall of 2 inches or more per hour at fuel pressures ranging from about 4 to about 45 psig using natural gas or propane as fuel. In addition, the pilot will stay lit in a 160 mph or more wind without flashback when burning a fuel containing up to 40% hydrogen.

The continuously operating flare pilot of this invention is basically comprised of a fuel-air mixture discharge nozzle connected to a fuel-air mixture inlet pipe. A wind shield having a partially closed or open lower end is sealingly attached to the fuel-air mixture discharge nozzle or to the fuel-air mixture inlet pipe whereby a fuel-air mixture discharged from the fuel-air discharge nozzle enters the interior of the wind shield. The wind shield has an open upper end which includes an upstanding wall portion positioned at the front of the wind shield facing the open end of a flare stack. Ignition flames from within the wind shield of the flare pilot are discharged through the open upper end of the wind shield adjacent to the combustible fluid discharged from the flare stack. The wind shield further includes at least one opening in each of the opposite sides of the wind shield positioned at substantially right angles to the upstanding wall portion through which wind can flow into the interior of the wind shield. Means for igniting the fuel-air mixture discharged within the wind shield by the fuel-air discharge nozzle and for detecting the presence or non-presence of flame therein can optionally be connected to the wind shield or discharge nozzle.

In a preferred embodiment, the wind shield and the upstanding wall portion of the open upper end of the wind shield include a plurality of downwardly orientated openings therein through which rain and wind are discharged when blowing in a direction from the back to the front of the wind shield. The wind shield also includes a plurality of openings in each of the opposite sides of the wind shield positioned at substantially right angles to the upstanding wall portion through which wind can flow into the interior of the wind shield. Wind catching baffles are also positioned around the pluralities of openings in the sides of the wind shield and the openings are orientated so that the wind flowing therethrough is caused to flow downwardly towards the inside lower end of the wind shield. The flare pilot preferably also includes a perforated flame stabilizer positioned within the wind shield attached to and surrounding the fuel-air nozzle. Finally, when included as a component of the flare pilot, the means for igniting the fuel-air mixture within the wind shield and for detecting the presence or non-presence of flame therein are preferably a flame front igniting apparatus and an acoustic flame detecting apparatus.

It is, therefore, a general object of the present invention to provide an improved continuously operating flare pilot for igniting combustible fluids discharged from the open end of a flare stack which is stable in high winds and other severe weather conditions.

Other and further objects, features and advantages of the present invention will be readily apparent to those skilled in the art upon a reading of the description of preferred embodiments which follows when taken in conjunction with the accompanying drawings.

BRIEF DESCRIPTION OF THE DRAWINGS

FIG. 1 is a side elevational view of a flare stack including the flare pilot of the present invention.

FIG. 2 is a top view taken along line 2—2 of FIG. 1.

FIG. 6*a* is a cross-sectional view taken along line 6—6 of FIG. 4.

FIG. 6*b* is a cross-sectional view similar to FIG. 6*a* which illustrates an alternate embodiment of the wind shield of this invention.

DESCRIPTION OF PREFERRED EMBODIMENTS

Figure 3:
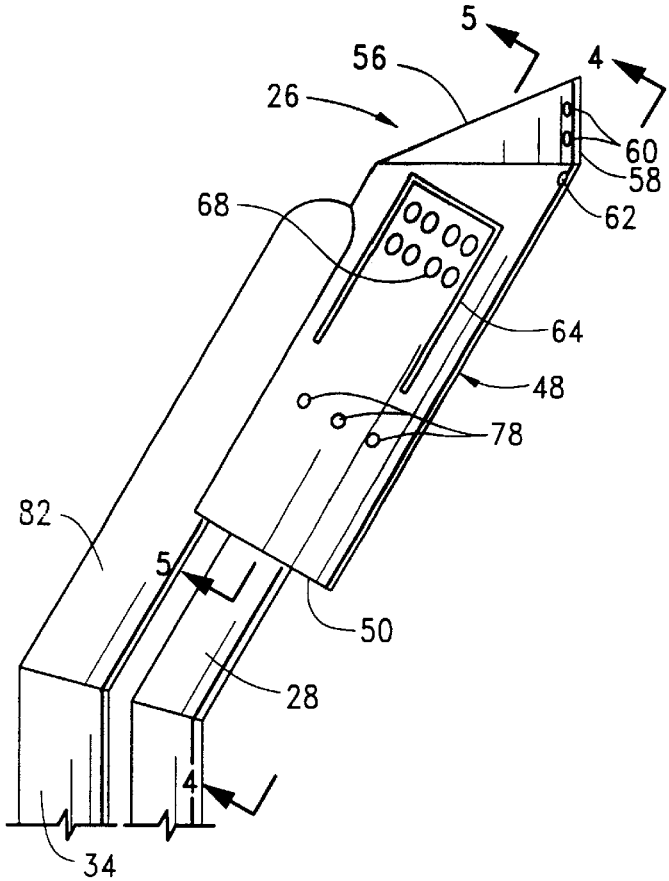
FIG. 3 is a side elevational view of the flare pilot of this invention.

Referring now to the drawings, and particularly to FIGS. 1 and 2, a flare stack including the improved flare pilot of the present invention is illustrated and generally designated by the numeral 10. The flare stack 10 includes a flare 12 and a stack 14 which are bolted together by a plurality of bolts 15 at a flanged connection 16. While the heights of flare stacks vary depending upon various factors, most flare stacks utilized in production, refining and processing plants range in height from about 20 feet to as high as about 600 feet. The bottom end of the stack 14 is closed by a ground level base plate 18 and one or more waste or other combustible fluid inlet pipes 20 located at or near ground level are connected to the stack 14. As mentioned above, most flare stacks are operated on demand for disposing of combustible wastes or other combustible fluid streams such as hydrocarbon streams which are diverted during venting, shut-downs, upsets and/or emergencies but the flare stack must be capable of receiving and continuously flaring combustible streams at any time.

The flare 12 (also sometimes referred to as a flare tip) can include a cylindrical perforated wind deflector 22 attached thereto adjacent to the upper open discharge end 24 thereof and at least one flare pilot 26 positioned adjacent the open discharge end 24. As mentioned, the flare pilot 26 is usually operated continuously to provide a continuous flame for igniting combustible fluids which are intermittently flowed to the flare stack 10.

The flare pilot 26 of this invention, which will be described further hereinbelow, is connected to a fuel-air mixture inlet pipe 28 which extends from the flare pilot 26 at the top of the flare stack 10 to a fuel-air mixer 32 and is attached to the flare stack 10 by a plurality of brackets 30. The fuel-air mixer 32, which is typically a venturi type of fuel-air mixer, is connected to the pipe 28 at a convenient location. The fuel-air mixer 32 preferably includes a wind shield 33 (shown schematically) or other similar means for preventing operation interruptions due to high winds and the like. The fuel-air mixer 32 is connected to a source of combustible gas such as natural gas, propane, refinery gas or the like by a fuel gas supply pipe 29. As is well understood, the fuel gas is mixed with aspirated atmospheric air as it flows through the mixer 32 and the resulting fuel-air mixture flows through the pipe 28 to the flare pilot 26 and is burned within and adjacent to the flare pilot 26 as will be described in detail hereinbelow.

When used, pipes 28 and 34 are provided which extend from the flare pilot 26 to a location at or near ground level. The pipe 34 is shown attached to the pipe 28 by a plurality of brackets 35 and is connected at its upper end to the pipe 82 which is in turn connected to the flare pilot 26. The lower end of the pipe 34 is connected to an ignition flame front generator 36 and a flame detector assembly 38 is connected to the pipe 34 near ground level between the ignition flame generator 36 and the flare pilot 26.

The flare pilot 26 is ignited by flowing a combustible fuel-air mixture to the pilot burner 26 by way of the pipe 28 and then operating the ignition flame front generator 36 to produce a flame which is propagated through the pipes 34 and 82 to the pilot burner 26. When the ignition flame exits the pipe 82 it ignites the fuel-air mixture discharged within the flare pilot 26. After the pilot burner 26 is ignited, the ignition flame front generator 36 is shut-off.

The sound produced by the flame of the flare pilot 26 is conducted by the pipe 34 to the flame detector assembly 38 connected thereto. The flame detector assembly 38 continuously indirectly detects the presence or non-presence of the flame in the pilot 26 from its location remote from the flare pilot 26 by detecting the presence or non-presence of a level of sound conducted by the pipe 34 which indicates flame. If the flame of the pilot 26 is extinguished for any reason, the flame detector assembly 38 provides a warning such as a light and/or audible alarm so that the pilot 26 can immediately be re-ignited. As will be understood by those skilled in the art, the ignition flame front generator 36 can be electronically connected to the flame detector assembly 38 whereby each time the flame detector assembly 38 detects the non-presence of a flame at the pilot 26, the ignition flame front generator 36 is automatically operated to re-light the pilot 26.

Referring now to FIGS. 3–7, the flare pilot 26 and the upper end portions of the pipes 28, 82 and 34 are illustrated in detail. The flare pilot 26 is comprised of a fuel-air mixture discharge nozzle 40 (sometimes referred to as a gas tip) which is connected to the fuel-air mixture inlet pipe 28 such as by welding or a threaded connection. The fuel-air mixture produced by the fuel-air mixer 32 flows through the fuel-air mixture inlet pipe 28 and into the fuel-air mixture discharge nozzle 40 from where the fuel-air mixture is discharged by way of a plurality of orifices 42 in the nozzle 40. Attached to and extending above the fuel-air mixture nozzle 40 is a perforated flame stabilizer 44. The flame stabilizer 44 is preferably cylindrical and includes a plurality of spaced perforations or openings 46 therein. The flame stabilizer 44 causes the fuel-air mixture discharged by way of the orifices 42 in the nozzle 40 to be circulated within and around the flame stabilizer whereby the fuel-air mixture begins to burn therein and the flame produced within and above the flame stabilizer 44 remains stable during pressure fluctuations within the flare pilot 26.

Also attached to the nozzle 40 or to the fuel-air mixture inlet pipe 28 or to the pipe 82 is a wind shield generally designated by the numeral 48. The wind shield 48 has a partially closed or open lower end 50. In the embodiment shown in the drawings, the lower end 50 of the windshield is partially closed, i.e., the bottom includes an annular plate 51 having a plurality of openings 52 therein. A plurality of drain openings 54 are also provided in the lower sides of the flame stabilizer 44. The wind shield 48 is preferably cylindrical in shape and it includes an open upper end 56.

Figure 4:
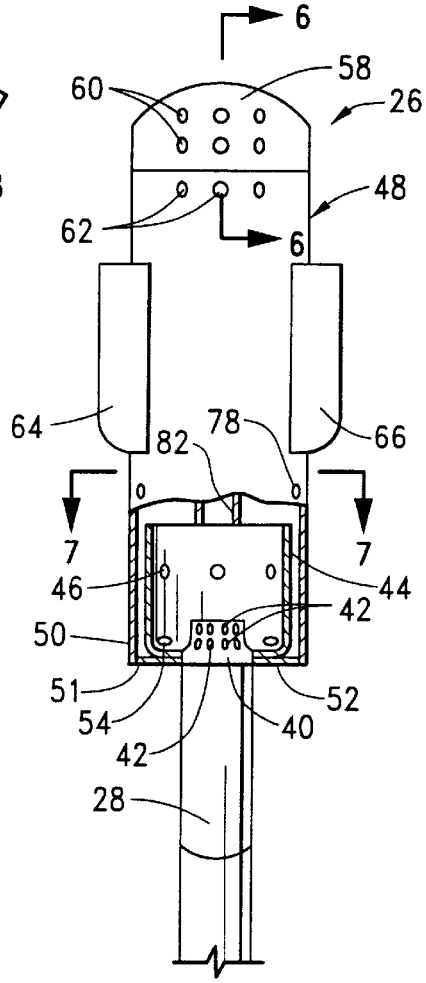
FIG. 4 is a side partially cut away view taken along line 4—4 of FIG. 3.

As best shown in FIGS. 1, 2, 3, 4 and 6*a* of the drawings, a substantially vertical upstanding wall portion 58 of the open upper end 56 of the wind shield 48 is positioned at the front of the wind shield 48 facing the open discharge end 24 of the flare stack 10. Ignition flames from within the wind shield 48 are discharged through the open upper end 56 of the wind shield 48 adjacent to the combustible fluid discharged from the flare stack 10. Preferably, as shown in FIG. 4, the wind shield 48 and the wall portion 58 thereof include at least one, and more preferably, a plurality of downwardly facing spaced openings 60 formed therein. The openings 60 function to allow a portion of rain and wind blowing in a direction from the back to the front of the wind shield 48 to exit the wind shield 48 without creating a substantial back pressure within the wind shield 48. As also shown in FIGS. 3, 4 and 6*a*, additional downwardly facing openings 62 can be formed in the front of the wind shield 48 below the upstanding portion 58 thereof.

Referring now to FIG. 6*b*, an alternate embodiment of the wind shield 48 is shown. That is, instead of being substantially vertical, the upstanding wall portion 58 of the wind shield 48 is inclined at the same angle as the rest of the wind shield 48. Either of the embodiments illustrated in FIGS. 6*a* or 6*b* can be utilized, but the embodiment illustrated in FIG. 6*b* may be slightly less costly to manufacture.

Figure 5A:
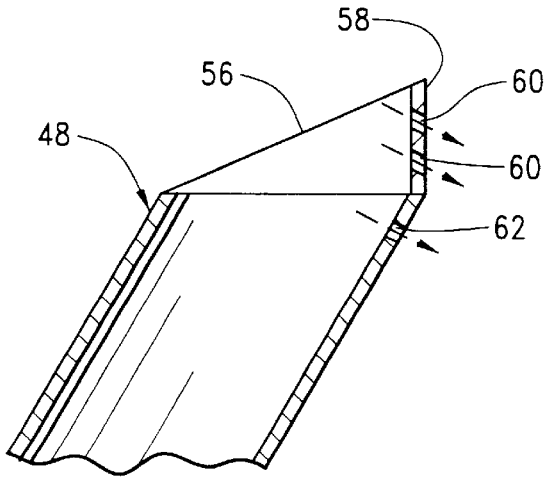
FIG. 5 is a cross-sectional view taken along line 5—5 of FIG. 3.
Figure 5B:
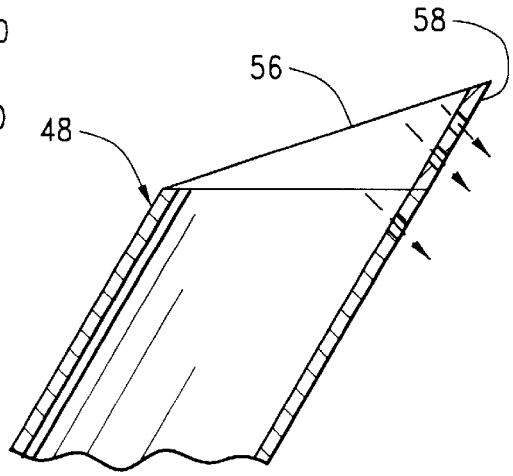
Figure 5:
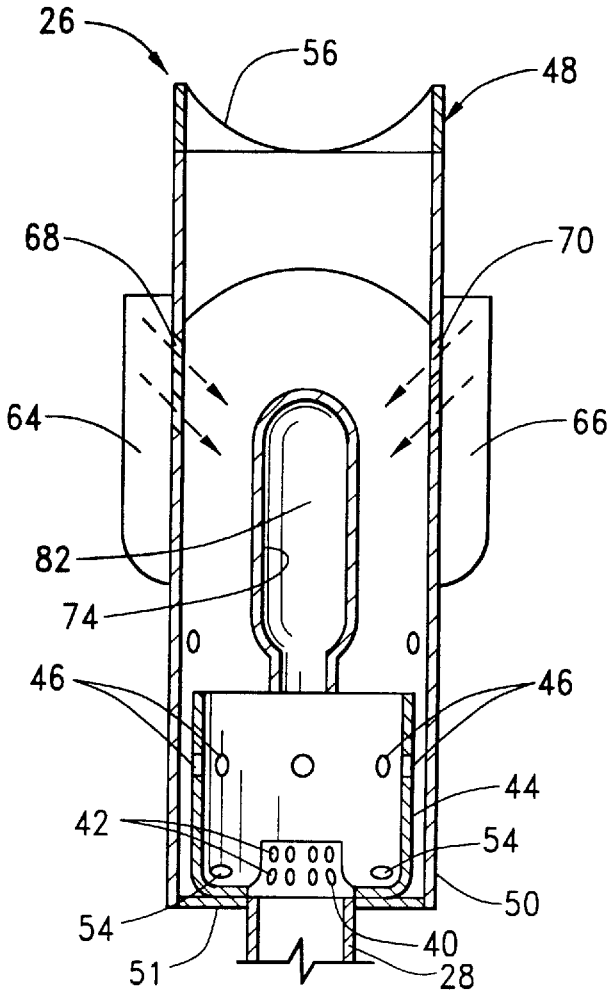

As best shown in FIGS. 3 and 5, preferably at least one opening, and more preferably, a plurality of openings is provided in each of the opposite sides of the wind shield 48 positioned at substantially right angles to said upstanding wall portion 58 thereof through which wind can flow into the interior of the wind shield 48. That is, one or a plurality of openings 68 are provided in one side of the wind shield 48 and one or a plurality of openings 70 are provided in the opposite side of the wind shield 48. The wind shield 48 also preferably includes a pair of outwardly extending wind capturing baffles 64 and 66 attached to opposite sides of the wind shield 48. Each of the baffles 64 and 66 is positioned substantially around one or a plurality of the openings 68 and 70, respectively. As will be described further hereinbelow, without the presence of the baffles 64 and 66 and/or the openings 68 and 70, wind blowing from one or the other sides of the flare pilot 26 causes a suction effect or vacuum to be created in the wind shield 48. The baffles 64 and 66 and/or the openings 68 and 70 cause a portion of the wind to be captured and flow through the opening or openings 68 or 70 into the interior of the wind shield 48 to thereby off set the suction effect and equalize the pressure within the wind shield 48. As shown in FIG. 5, the openings 68 and 70 are preferably positioned so that the captured wind flowing through the openings is caused to flow towards the lower end 50 of the wind shield 48.

Figure 7:
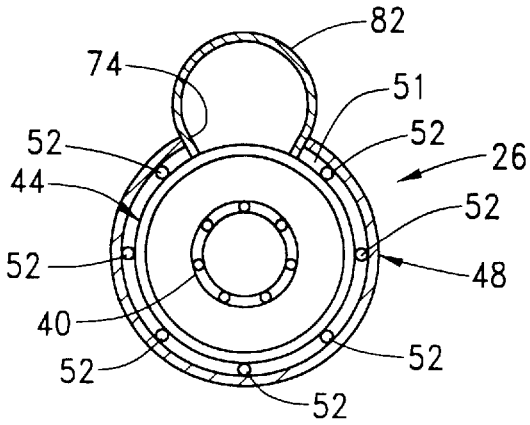
FIG. 7 is a cross-sectional view taken along line 7—7 of FIG. 4.

Referring again to FIGS. 1 and 2 and as mentioned above, when used, the upper end of the pipe 82 is connected to the flare pilot 26. The lower end of the pipe 34 is connected to the apparatus for igniting the fuel-air mixture discharged within the wind shield 48 and to apparatus for detecting the presence or non-presence of flame therein, i.e., the ignition flame front generator 36 and the flame detector assembly 38. As best shown in FIGS. 5 and 7, the upper end of the pipe 82 is sealingly connected to an elongated slot 74 in a side of the wind shield 48.

As will now be understood, the ignition flame propagated through the pipes 34 and 82 from the ignition flame front generator 36 enters the interior of the wind shield 48 by way of the slot 74 and ignites the fuel-air mixture discharged within the interiors of the flame stabilizer 44 and wind shield 48 by the nozzle 40. In addition, the presence or non-presence of the level of sound produced by flame emanating from the interior of the wind shield 48 is conducted by the pipes 82 and 34 to the flame detector assembly 38. A plurality of spaced openings 78 are optionally included in the wind shield 48 at a location adjacent to the slot 74 to relieve the pressure created when the fuel-air mixture discharged by the nozzle 40 is ignited by an ignition flame propagated through the slot 74.

In the operation of the flare pilot 26, pressurized fuel gas from a source thereof is conducted by the pipe 29 to the fuel-air mixer 32 wherein atmospheric air is mixed with the fuel gas. The resulting fuel-air mixture flows through the conduit 28 and through the orifices 42 of the fuel-air mixture discharge nozzle 40 into the interior of the flame stabilizer 44 and the wind shield 48. When used, the ignition flame front generator 36 is operated to produce an ignition flame which is propagated through the pipes 34 and 82 and through the slot 74 in the wind shield 48 of the flare pilot 26 to thereby ignite the fuel-air mixture flowing into the flame stabilizer 44 and the wind shield 48. The ignition flames produced by the flare pilot 26 within the wind shield 48 extend through the open end 56 of the wind shield 48 and ignite combustible fluid streams flowing out of the open discharge end 24 of the flare stack 10.

It has been found that when a high wind, i.e., a wind having a velocity up to and greater than 125 mph contacts a conventional flare pilot, one of two things can take place that extinguishes the flare pilot flame. That is, either the high wind creates a suction effect that increases air entrainment in the fuel-air mixture which causes the fuel-air mixture to be outside its flammability range and extinguishes the pilot flame, or the wind creates a positive pressure or pushing effect on the flare pilot fuel-air nozzle which retards, stops or reverses the flow of the fuel-air mixture and extinguishes the pilot flame. Referring to FIG. 2 of the drawing, the pushing effect takes place when a high wind contacts a conventional flare pilot in the direction indicated by the arrow 80, i.e., in a direction head-on to the front of the flare pilot 26. The suction effect is produced when a high wind contacts a conventional flare pilot from the side, i.e., from the direction indicated by the arrows 82 or 84, or to a lesser extent from the rear, i.e., the direction indicated by the arrow 86.

The flare pilot of the present invention eliminates the high wind flame extinguishing problems associated with the above described pushing effect and suction effect. That is, the high wind pushing effect is eliminated by the flare pilot of the present invention as a result of the provision of the wind shield 48 having an open upper end 56 which includes an upstanding wall portion 58 positioned at the front of the wind shield 48. A high wind flowing over the open discharge end 24 of the flare stack 10 in the direction indicated by the arrow 80 develops a downward momentum due in part to the low pressure zone created by the wind at the downstream side of the flare stack 10. The downward flow of the wind enters the conventional flare pilots utilized heretofore and causes the pushing effect. This is contrasted with the flare pilot 26 of this invention that includes the upstanding wall portion 58 which shields the front of the opening 56 and prevents or partially prevents wind from entering the wind shield 48. While the wall portion 58 includes the openings 60 therein, the openings 60 are preferably orientated at a downward angle from the inside to the outside of the wall portion which effectively prevents the wind in the opposite direction from entering the windshield 48. Thus, the pushing effect does not occur in the flare pilot 26 of this invention to a great enough degree to extinguish the flare pilot flames even when the wind speed is as high as 160 mph in the direction of the arrow 80.

When a high wind contacts the flare pilot 26 from a side direction indicated by either of the arrows 82 or 84, the suction effect is wholly or partially prevented by the inlet opening or openings 68 or 70 which are positioned in opposite sides of the wind shield 48 at substantially right angles to the front of the windshield facing the open end of the flare stack 10. When used, the U-shaped wind baffles 64 or 66 capture additional wind which flows into the interior of the wind shield 48 by way of the openings 68 or 70. This wind flow prevents or reduces the suction effect whereby it does not occur in the flare pilot 26 to a great enough degree to extinguish the flare pilot flames.

As will be understood by those skilled in the art, when the wind direction is in between the directions indicated by the arrows 80, 82, 84 and 86, any suction effect or pushing effect produced is cancelled as described above by a combination of the wall portion 58, and the various openings in the wind shield 48 which function as described above.

It is known in the prior art to ignite combustible fluids discharged from the open end of a flare stack with one or more continuously operating flare pilots positioned adjacent to the open end of the flare stack. The flare pilots utilized heretofore have been comprised of a fuel-air mixture inlet pipe, a fuel-air mixture discharge nozzle connected to the fuel-air inlet mixture pipe and a wind shield having an open upper end and a lower end attached to the fuel-air mixture discharge nozzle, the fuel-air mixture inlet pipe or the like. In high winds, rain and other severe weather, both the heretofore used flare pilots and the combustible fluid being flared have sometimes been extinguished which allowed the waste or other fluid being flared to be discharged directly into the atmosphere without being combusted.

In accordance with a method of the present invention, an improved flare pilot is utilized which remains lit at very high wind speeds in combination with very high rain amounts, i.e., the method includes the steps of providing a heretofore utilized flare pilot as described above with an upstanding wall portion positioned at the front of the windshield which faces the open end of the flare stack and/or providing at least one opening in each of the opposite sides of the wind shield at substantially right angles to the upstanding wall portion with or without outwardly extending wind capturing baffles through which wind can flow into the interior of the windshield.

Another method of the present invention for igniting combustible fluids discharged from the open end of a flare stack in high winds, rain and other severe weather comprises the steps of: (a) attaching at least one flare pilot which remains lit in winds having speeds up to 160 miles per hour or more combined with rainfall of 2 inches or more to the open end of the flare stack, the flare pilot being comprised of a fuel-air mixture discharge nozzle connected to the fuel-air mixture inlet pipe, a wind shield having a lower end attached to the fuel-air mixture discharge nozzle or the fuel-air mixture inlet conduit whereby a fuel-air mixture discharged from the fuel-air mixture discharge nozzle enters the interior of the wind shield, the wind shield having an open upper end and having an upstanding wall portion of the open upper end facing the open end of the flare stack and/or at least one opening in each of the opposite sides positioned at substantially right angles to the upstanding wall portion through which wind can flow into the interior of the wind shield; and (b) continuously operating the flare pilot to continuously ignite flammable fluids discharged from the open end of the flare stack.

In order to further illustrate the flare pilot apparatus of this invention, its operation and the methods of the invention, the following example is given.

EXAMPLE

Both a conventional flare pilot and a flare pilot of this invention were installed in a test facility and a large blower was utilized to generate wind. The flare pilots were operated to produce ignition flames and winds generated by the blower having speeds up to 160 mph or more were caused to contact the operating flare pilots from each of the directions indicated by the arrows 80, 82, 84 and 86 illustrated in FIG. 2 of the drawings. It was found that for a conventional flare pilot the greatest pushing effect was generated when the wind contacted the conventional flare pilot from the direction indicated by the arrow 80 and the greatest suction effect was generated by wind which contacted the flare pilot from the directions indicated by the arrows 82 or 84. In addition to the wind, the operating flare pilots were contacted with simulated rainfall at a rate up to and including 60 inches per hour. Several different fuels were utilized during the tests, i.e., propane, natural gas and natural gas with up to 40% hydrogen mixed therewith. The natural gas and propane fuels were utilized at pressures between 4 psig and 30 psig and the natural gas combined with hydrogen was utilized at pressures between 12 psig and 15 psig.

The test results demonstrated that the conventional flare pilot was rapidly extinguished at relatively low wind speeds and simulated rainfall. The flare pilot of this invention, on the other hand, stayed lit when contacted with wind at a speed of 160 mph with and without rainfall at the rate of 2 or more inches per hour at all positions around the flare pilot utilizing all of the various fuels described above.

Thus, the present invention is well adapted to carry out the objects and attain the ends and advantages mentioned as well as those which are inherent therein. While numerous changes may be made by those skilled in the art, such changes are encompassed within the spirit of this invention as defined by the appended claims.

What is claimed is:

1. A continuously operating flare pilot for igniting flammable fluids discharged from the open end of a flare stack which is stable in high winds and other severe weather conditions comprising:

a fuel-air mixture inlet pipe;

a fuel-air mixture discharge nozzle connected to said fuel-air mixture inlet pipe;

a wind shield having a lower end attached to said fuel-air mixture discharge nozzle or said fuel-air mixture inlet pipe whereby a fuel-air mixture discharged from said fuel-air mixture discharge nozzle enters the interior of said wind shield, said wind shield having an open upper end which includes an upstanding wall portion positioned at the front of said wind shield facing said open end of said flare stack;

at least one opening in each of the opposite sides of said wind shield positioned at substantially right angles to said upstanding wall portion through which wind can flow into the interior of said wind shield; and an outwardly extending wind capturing baffle attached to each of said opposite sides of said wind shield and positioned substantially around said openings therein.

2. The flare pilot of claim 1 wherein said wind catching baffles are formed in the shape of an inverted U.

3. The flare pilot of claim 1 wherein each of said wind catching baffles is positioned substantially around a plurality of openings in said wind shield.

4. The flare pilot of claim 3 wherein said plurality of openings in said wind shield within each baffle are orientated so that wind flowing through said openings is caused to flow downwardly towards the lower end of said wind shield.

5. A continuously operating flare pilot for igniting flammable fluids discharged from the open end of a flare stack which is stable in high winds and other severe weather conditions comprising:

a fuel-air mixture inlet pipe;

a fuel-air mixture discharge nozzle connected to said fuel-air mixture inlet pipe; and a wind shield having an open upper end and a lower end attached to said fuel-air mixture discharge nozzle or said fuel-air mixture inlet pipe whereby a fuel-air mixture discharged from said fuel-air mixture discharge nozzle enters the interior of said wind shield;

at least one opening in each of the opposite sides of said wind shield positioned at substantially right angles to the front of said wind shield facing the open end of said flare stack; and an outwardly extending wind capturing baffle attached to each of said opposite sides of said wind shield and positioned substantially around said openings therein.

6. The flare pilot of claim 5 wherein the open upper end of said wind shield further comprises an upstanding wall portion positioned at the front of said wind shield facing said open end of said flare stack.

7. The flare pilot of claim 5 which further comprises means for igniting said fuel-air mixture discharged from said fuel-air discharge nozzle attached to said wind shield.

8. The flare pilot of claim 5 which further comprises means for detecting the presence or non-presence of flame within said wind shield attached to said wind shield.

9. The flare pilot of claim 6 which further comprises at least one opening in said upstanding wall portion of said open upper end of said wind shield for discharging rain and wind from inside said open upper end of said wind shield to the outside thereof.

10. The flare pilot of claim 6 which further comprises a plurality of openings in said upstanding wall portion of said open upper end of said wind shield for discharging rain and wind from inside said open upper end of said wind shield to the outside thereof.

11. The flare pilot of claim 5 wherein said wind shield is generally of cylindrical shape.

12. The flare pilot of claim 5 which further comprises a perforated flame stabilizer positioned within said wind shield attached to and surrounding said fuel-air nozzle.

13. The flare pilot of claim 5 wherein said wind catching baffles are formed in the shape of an inverted U.

14. The flare pilot of claim 5 wherein each of said wind catching baffles is positioned substantially around a plurality of openings in said wind shield.

15. The flare pilot of claim 14 wherein said plurality of openings in said wind shield within each baffle are orientated so that wind flowing through said openings is caused to flow downwardly towards the lower end of said wind shield.

16. The flare pilot of claim 7 wherein said means for igniting said fuel-air mixture within said wind shield is a flame front igniting apparatus.

17. The flare pilot of claim 8 wherein said means for detecting the presence or non-presence of flame therein is an acoustic flame detecting apparatus.

18. The flare pilot of claim 5 which further comprises a flame igniting and detecting apparatus comprised of a pipe having an end attached to and communicated with the interior of said wind shield and a length whereby an ignition flame can be propagated through said pipe to ignite said fuel-air mixture in said wind shield and whereby sound produced by flames within said wind shield are conducted by said pipe to a location remote from said flare pilot, an ignition flame front generator connected to said pipe at said remote location for producing an ignition flame that propagates through said pipe, a sound detector connected to said pipe at said remote location for detecting sound conducted by said pipe and for generating an electric signal representative of said sound, and electronic means for receiving said signal and indicating the presence or non-presence of said flame in response thereto.

19. The flare pilot of claim 7 wherein said wind shield includes at least one opening therein to relieve pressure when said fuel-air mixture is ignited.

20. A continuously operating flare pilot for igniting a flammable fluid discharged from the open end of a flare stack which is stable in high winds and other severe weather conditions comprising:

a fuel-air mixture inlet pipe;

a fuel-air mixture discharge nozzle connected to said fuel-air mixture inlet pipe;

a wind shield having a lower end attached to said fuel-air mixture discharge nozzle or said fuel-air mixture inlet pipe whereby a fuel-air mixture discharged from said fuel-air mixture discharge nozzle enters the interior of said wind shield, said wind shield having an open upper end and having an upstanding wall portion of said open upper end positioned at the front of said wind shield facing said open end of said flare stack and said upstanding wall portion including a plurality of downwardly orientated openings therein for discharging rain and wind from inside said open upper end of said wind shield to the outside thereof;

a plurality of openings in each of the opposite sides of said wind shield positioned at substantially right angles to said upstanding wall portion through which wind can flow into the interior of said wind shield; and a pair of outwardly extending wind capturing baffles attached to said opposite sides of said wind shield, each of said baffles being positioned substantially around one of said pluralities of openings in said wind shield.

21. The flare pilot of claim 20 which further comprises:

a flame stabilizer positioned within said wind shield attached to and surrounding said fuel-air nozzle; and a flame igniting and detecting apparatus attached to said wind shield.

22. The flare pilot of claim 20 wherein said wind shield further comprises a plurality of downwardly orientated openings therein below said upstanding wall portion thereof for discharging rain and wind from inside said open upper end of said wind shield to the outside thereof.

23. The flare pilot of claim 20 wherein said wind shield is generally of cylindrical shape.

24. The flare pilot of claim 20 wherein said internal perforated flame stabilizer is generally of cylindrical shape.

25. The flare pilot of claim 20 wherein said wind catching baffles are formed in the shape of an inverted U.

26. The flare pilot of claim 20 wherein said plurality of openings within each baffle are orientated so that wind flowing through said openings is caused to flow downwardly towards the lower end of said wind shield.

27. The flare pilot of claim 20 wherein said flame igniting and detecting apparatus is comprised of a pipe having an end attached to and communicated with the interior of said wind shield and a length whereby an ignition flame can be propagated through said pipe to ignite said fuel-air mixture in said wind shield and whereby sound produced by flames within said wind shield are conducted by said pipe to a location remote from said flare pilot, an ignition flame front generator connected to said pipe at said remote location for producing an ignition flame that propagates through said pipe, a sound detector connected to said pipe at said remote location for detecting sound conducted by said pipe and for generating an electric signal representative of said sound, and electronic means for receiving said signal and indicating the presence or non-presence of said flame in response thereto.

28. In a method of igniting combustible fluids discharged from the open end of a flare stack with a continuously operating flare pilot positioned adjacent to the open end of the flare stack in high winds, rain and other severe weather, the flare pilot being comprised of a fuel-air mixture inlet pipe, a fuel-air mixture discharge nozzle connected to the fuel-air inlet mixture pipe and a wind shield having an open upper end and a lower end attached to the fuel-air mixture discharge nozzle or the fuel-air mixture inlet pipe, the improvement which comprises:

providing said open upper end of said wind shield of said flare pilot with an upstanding wall portion positioned at the front of said wind shield which faces said open end of said flare stack;

providing at least one opening in each of the opposite sides of said wind shield at substantially right angles to said upstanding wall portion through which wind can flow into the interior of said windshield; and providing an outwardly extending wind capturing baffle attached to each side of said wind shield and positioned substantially around said opening therein.

29. The method of claim 28 wherein said wind catching baffles are formed in the shape of an inverted U.

30. The method of claim 28 wherein each of said wind catching baffles is positioned substantially around a plurality of openings in said wind shield.

31. The method of claim 30 wherein said plurality of openings in said wind shield within each baffle are orientated so that wind flowing through said openings is caused to flow downwardly towards the lower end of said wind shield.

32. In a method of igniting combustible fluids discharged from the open end of a flare stack with a continuously operating flare pilot positioned adjacent to the open end of the flare stack in high winds, rain and other severe weather, the flare pilot being comprised of a fuel-air mixture inlet pipe, a fuel-air mixture discharge nozzle connected to the fuel-air inlet mixture pipe and a wind shield having an open upper end and a lower end attached to the fuel-air mixture discharge nozzle or the fuel-air mixture inlet pipe, the improvement which comprises:

providing at least one opening in each of the opposite sides of said wind shield at substantially right angles to said upstanding wall portion through which wind can flow into the interior of said wind shield; and providing an outwardly extending wind capturing baffle attached to each of said opposite sides of said wind shield and positioned substantially around said openings therein.

33. The method of claim 32, which further comprises the step of providing said open upper end of said wind shield of said flare pilot with an upstanding wall portion positioned at the front of said wind shield which faces the open upper end of said flare stack.

34. The method of claim 33 which further comprises the step of providing at least one opening in said upstanding wall portion at the front of said wind shield for discharging rain and wind from inside said open upper end of said wind shield.

35. The method of claim 33 which further comprises the step of providing a plurality of openings in said upstanding wall portion of said wind shield for discharging rain and wind from inside said upper end of said wind shield to the outside thereof.

36. The method of claim 32 wherein said wind shield is generally of cylindrical shape.

37. The method of claim 32 wherein said flare pilot further comprises a perforated flame stabilizer positioned within said wind shield attached to and surrounding said fuel-air nozzle.

38. The method of claim 32 wherein said wind catching baffles are formed in the shape of an inverted U.

39. The method of claim 32 wherein each of said wind catching baffles is positioned substantially around a plurality of openings in said wind shield.

40. The method of claim 39 wherein said plurality of openings in said wind shield within each baffle are orientated so that wind flowing through said openings is caused to flow downwardly towards the lower end of said wind shield.

41. A method of igniting combustible fluids discharged from the open end of a flare stack in high winds, rain and other severe weather comprising the steps of:

(a) attaching at least one flare pilot which remains lit in winds having speeds up to 160 miles per hour or more combined with rainfall of 2 inches or more to said open end of said flare stack, the flare pilot being comprised of a fuel-air mixture inlet pipe, a fuel-air mixture discharge nozzle connected to said fuel-air mixture inlet pipe, a wind shield having a lower end attached to said fuel-air mixture discharge nozzle or said fuel-air mixture inlet pipe whereby a fuel-air mixture discharged from said fuel-air mixture discharge nozzle enters the interior of said wind shield, said wind shield having an open upper end and having an upstanding wall portion of said open upper end facing said open end of said flare stack and at least one opening in each of the opposite sides positioned at substantially right angles to said upstanding wall portion through which wind can flow into the interior of said wind shield, and an outwardly extending wind capturing baffle attached to each of said opposite sides of said wind shield and positioned substantially around said opening therein; and (b) continuously operating said flare pilot to ignite combustible fluids discharged from the open end of said flare stack.

42. The method of claim 41 wherein said wind catching baffles are formed in the shape of an inverted U.

43. The method of claim 41 wherein each of said wind catching baffles is positioned substantially around a plurality of openings in said wind shield.

44. The method of claim 43 wherein said plurality of openings in said wind shield within each baffle are orientated so that wind flowing through said openings is caused to flow downwardly towards the lower end of said wind shield.

* * * * *